US005151690A

United States Patent [19]

Yamazaki

[11] Patent Number: 5,151,690

[45] Date of Patent: Sep. 29, 1992

[54] METHOD AND APPARATUS FOR DRIVING A LIQUID CRYSTAL DISPLAY PANEL

[75] Inventor: Katsunori Yamazaki, Suwa, Japan

[73] Assignee: Seiko Epson Corporation, Tokyo, Japan

[21] Appl. No.: 642,107

[22] Filed: Jan. 16, 1991

Related U.S. Application Data

[63] Continuation-in-part of Ser. No. 232,750, Aug. 18, 1988, Pat. No. 5,010,326.

[30] Foreign Application Priority Data

Jan. 16, 1990 [JP] Japan ..... 2-6677

[51] Int. Cl.[5] ..... G09G 3/36

[52] U.S. Cl. ..... 340/784; 340/765; 340/805

[58] Field of Search ..... 340/784, 784 D1, 784 D2, 340/765, 805

[56] References Cited

U.S. PATENT DOCUMENTS 4,748,444 5/1988 Arai ..... 340/765

5,010,326 4/1991 Yamazaki et al. ..... 340/765

*Primary Examiner*—Jeffery A. Brier

*Assistant Examiner*—A. Au

*Attorney, Agent, or Firm*—Blum Kaplan

[57] ABSTRACT

A method and apparatus for driving a liquid crystal panel is disclosed, wherein the scanning electrodes are formed on one of two substrates between which a liquid crystal layer is interposed. Signal electrodes are formed on the other substrate. Scanning electrode voltage driving waveforms consisting of selective and non-selective voltages are applied to the scanning electrodes of the liquid crystal panel. Lighting and non-lighting voltage waveforms are applied to the signal electrodes of the liquid crystal panel. The polarity of the lighting and non-lighting voltages and selective and non-selective voltages of the scanning electrodes are inverted at predetermined periods to avoid any DC effect. A period is provided for in which the selective voltage is not applied to any scanning electrodes. During this unapplied period, a compensating voltage is applied to each signal electrode in accordance with the number of variations of voltages applied to the signal electrode with respect to the non-selective voltage applied to the scanning electrode during a preceding predetermined period.

19 Claims, 14 Drawing Sheets

COMPENSATING TIME TC
DISPLAY PERIOD
COMPENSATING TIME tc
DISPLAY PERIOD
F1
F2
V0
V1
V2
V3
V4
V5
TC T1 T2 T3 T4 T5 T6 TC t1 t2 t3 t4 t5 t6 tc

COMPENSATING TIME TC
DISPLAY PERIOD
COMPENSATING TIME tc
DISPLAY PERIOD
F1
F2
V0
V1
V2
V3
V4
V5
TC T1 T2 T3 T4 T5 T6 TC t1 t2 t3 t4 t5 t6 tc

V
0
-V

COMPENSATING TIME TC
COMPENSATING TIME tc
DISPLAY PERIOD
DISPLAY PERIOD
F1
F2
V0
V1
V2
V3
V4
V5
tc T1 T2 t3 t4 T5 T6 TC t1 t2 T3 T4 t5 t6 tc

V0
V1
V2
V3
V4
V5

V
0
-V

METHOD AND APPARATUS FOR DRIVING A LIQUID CRYSTAL DISPLAY PANEL

This is a continuation in part of application Ser. No. 07/232,750, filed Aug. 15, 1988.

BACKGROUND OF THE INVENTION

This invention relates to a method and apparatus for driving a liquid crystal display device and, in particular, for a method and apparatus for driving a liquid crystal display device which provides a uniform display and reduces unevenness of display. While liquid crystal display devices have taken many forms, simple matrix type liquid crystal display devices are generally driven by a voltage averaging method. The liquid crystal is driven by applying a selective voltage sequentially to each scanning electrode, and applying a lighting or non-lighting voltage to each signal electrode in sync with the scanning electrode that receives the selective voltage.

The liquid crystal panel is provided with scanning and signal electrodes each having a resistance which is greater then zero (0) and a liquid crystal layer which acts as a dielectric. Therefore, the effective voltage at the display elements or dots formed by the intersection of each scanning electrode and signal electrode changes depending upon the nature of the characters and images displayed by the liquid crystal panel. This results in unevenness of display on the display device.

This is a problem that has been well known in the art. Many problem solving techniques have been used in the past, such as the line inverse driving method. The line inverse driving method is a method whereby the polarity of the voltage applied to the liquid crystal panel is inverted a multiplicity of times within each frame. This method is disclosed in Japanese Patent Laid-Open Publication Nos. 31825/1987, 19195/1985 and 19196/1985.

The line inverse driving method has the effect of decreasing the unevenness of display. The unevenness of display is caused by changes in the optical characteristics of the liquid crystal display device, which are caused by changes in the frequency components of the voltages applied to the scanning and signal electrodes. Thus, the line inverse driving method cannot completely eliminate the unevenness of display.

Referring to FIG. 1 the unevenness of display caused by the above referenced factors is explained. FIG. 1 is a schematic perspective view of a liquid crystal panel showing an example of a display pattern. FIG. 1 depicts a liquid crystal panel generally indicated as 1, composed of a liquid crystal layer 5, a first substrate 2 and a second substrate 3 for sandwiching the liquid crystal layer 5 therebetween. A plurality of scanning electrodes Y1–Y6 are formed on substrate 2 in the horizontal direction and a plurality of signal electrodes X1–X6 are formed on substrate 3 in substantially the vertical direction. Each intersection of a scanning electrode Y1–Y6 and a signal electrode X1–X6 forms a display element (dot) 7. Display elements 7 marked with crosshatching represent the lighting or illuminated state and display elements 7 without crosshatching represent the non-lighting or non-illuminated state. The display panel of FIG. 1 is shown as a 6×6 matrix or 36 display elements for simplicity, however, in exemplary embodiments the number of display elements of liquid crystal panel 1 maybe greater.

The liquid crystal panel is driven by the sequential application of the selective voltage to scanning electrodes Y1–Y6. This procedure of applying the selective voltage sequential to scanning electrodes Y1–Y6 is continually repeated. Simultaneously with the application of the selective voltage to scanning electrodes Y1–Y6, lighting and non-lighting voltages are applied to signal electrodes X1–X6. The result of a signal electrode being applied with the lighting voltage intersecting a scanning electrode being applied with the selective voltage, is a display element 7 being in the lighting condition. Alternatively, if the non-lighting voltage is applied to the signal electrode then all display elements formed by the intersection of that signal electrode with a scanning electrode will be non-lighting display elements. When the effective voltage applied to the display element increases beyond a threshold voltage, positive display results. Positive display is the term used to represent the lighting condition when the display element is dark (rendered visible).

In order to prevent direct current from being applied to the liquid crystal panel 1, after the application of the selective voltage to scanning electrodes Y1–Y6 (which is called one frame, indicated by F1 in FIG. 3), the next frame is driven by a selective voltage which has its polarity inverted from the previous frame (this period is indicated as F2 of FIG. 3).

Even if the resistances of the scanning electrodes Y1–Y6 were set ideally to zero (0), which is not possible, a low pass filter would nevertheless be formed by the resistances of signal electrodes X1–X6 and the capacitances resulting from the display elements, the liquid crystal material serving as the dielectric substance. FIG. 2 is a schematic diagram illustrating the low-pass filter. In FIG. 2, R represents the resistance of each individual signal electrode X1–X6, and C represents the capacitance formed by each display element. The ground represents the scanning electrodes having a resistance of zero. Referring to FIG. 2, the low pass filter causes the voltage waveform applied to the signal electrodes to become attenuated with respect to the ground (wherein the ground is represented by the scanning electrode). Thus, the effective voltage between the signal electrode and the scanning electrode is reduced when the frequency of changes from the lighted to the non-lighted state increases.

With reference to FIG. 1, the display elements depicted by the intersection of signal electrode X2 and scanning electrodes Y1–Y6 frequently change in state from the lighting condition to the non-lighting condition. The sequence of voltages of the data driving waveform applied to signal electrode X2 in FIG. 1 is: non-lighting, lighting, non-lighting, lighting, non-lighting and lighting voltage. There is much larger attenuation of the signal electrode voltage in the case of signal electrode X2 then in the case of signal electrodes X4, because in the case of signal electrodes X4 the signal electrode voltage is infrequently switched from the lighting to non-lighting voltage. In the case of signal electrode X4 the sequence of voltages of the data driving waveform applied to signal electrode X4 are as follows: non-lighting, lighting, lighting, lighting, lighting and non-lighting voltage. Thus, the voltage waveforms applied to signal electrodes X2 and X4 and the scanning electrodes Y1–Y6 are represented by FIGS. 3(*a*)–3(*c*) and FIGS. 4(*a*)–4(*c*).

FIGS. 3(*a*)–3(*c*) and 4(*a*)–4(*c*) are voltage waveform diagrams depicting the voltage waveform applied to the signal electrodes and scanning electrodes over time. The vertical axis represents the voltage applied and the horizontal axis represents the unit of time for which that voltage is applied. The periods T1, T2, T3 . . . , T6 represent the first frame, F1, in which T1 is the period in which the selective voltage is applied to scanning electrode Y1, T2 is the period in which the selective voltage is applied to scanning electrode Y2, T3 is the period in which the selective voltage is applied to scanning electrode Y3, . . . , and T6 is the period in which the selective voltage is applied to scanning electrode Y6. In frame F2 the period t1 is the period in which the selective voltage is applied to scanning electrode Y1, t2 is the period in which the selective voltage is applied to scanning electrode Y2, t3 is the period in which the selective voltage is applied to scanning electrode Y3, . . . , and t6 is the period in which the selective voltage is applied to scanning electrode Y6.

During frame F1, the voltages V0, V4, V5 and V3 are selective, non-selective, lighting and non-lighting voltages, respectively. During frame F2 the voltages V5, V1, V0 and V2 are selective, non-selective, lighting and non-lighting voltages, respectively.

FIG. 3(*a*) depicts the voltage waveform of signal electrode X2. FIG. 3(*b*) illustrates the voltage waveform of scanning electrode Y4. FIG. 3(*c*) depicts the difference between the voltage waveform of signal electrode X2, and scanning electrode Y4 or the difference between FIG. 3(*a*) and 3(*b*). Similarly, FIG. 4(*a*) depicts the voltage waveform of signal electrode X4. FIG. 4(*b*) depicts the voltage waveform of scanning electrode Y4. FIG. 4(*c*) illustrates the difference between the voltage waveforms of signal electrode X4, and scanning electrode Y4 or the difference between FIG. 4(*a*) and FIG. 4(*b*).

In the waveform diagrams, the hatched portions represent the deficiencies from the ideal voltage waveforms. When FIG. 3(*c*) and FIG. 4(*c*) are compared it can be seen that in the waveform diagram of FIG. 3(*c*) there are more deficiencies than in the waveform of FIG. 4(*c*). Therefore, the display element on signal electrode X2 is considerably pale, and the display element on signal electrode X4 is slightly pale.

The line inverse driving method discussed above can help to decrease the non-uniformity of display. However, the line inverse driving method cannot decrease the unevenness of display in all cases. Therefore, to decrease unevenness of display in all cases, caused by the circumstances described above, other methods of decreasing unevenness of display must be employed.

SUMMARY OF THE INVENTION

Generally speaking, in accordance with the invention, a method and apparatus for driving a high definition liquid crystal display device that compensates for attenuation in the voltage waveform caused by changes in the voltage applied to the signal electrodes is provided. Specifically, this invention is designed to reduce the unevenness of display produced by a display pattern in which there are many changes in the voltage applied to a signal electrode. This unevenness of display is corrected by providing a time in which no selective voltage is applied to any scanning electrode. During this time a compensating voltage having a magnitude based upon the regularity of the display pattern is applied to each of the signal electrodes.

In accordance with the invention, a method and apparatus is provided for driving a liquid crystal panel having a plurality of display elements which can be in the lighting condition and the non-lighting condition to produce a pattern to be displayed, the panel including a first substrate and a second substrate spaced apart with liquid crystal material disposed therebetween. The first substrate carries a group of scanning electrodes disposed thereon. The second substrate carries a group of signal electrodes disposed thereon. The scanning electrodes are applied with a scanning driving waveform including selective and non-selective voltages, and the signal electrodes are applied with a data driving waveform including lighting and non-lighting voltages. The polarities of the lighting and non-lighting voltages applied to the signal electrodes and the selective and non-selective voltages applied to the scanning electrodes are periodically inverted in polarity. For a time period just prior to inverting the polarities of the lighting and non-lighting voltages there is a period in which no scanning electrode is applied with a selective voltage, and during this unapplied time, a compensating voltage is applied to each signal electrode of the liquid crystal panel in accordance with the number of variations or the voltages applied to each respective signal electrode.

The compensating voltage is applied to each signal electrode for a certain time period that is determined by the number of variations in the polarity of the voltage applied to that signal electrode with respect to the non-selective voltage being applied to the scanning electrode. This compensating voltage is applied for a longer period of time when there are more variations in the polarity of the signal electrode during one frame. The compensating voltage is applied for a period referred to as the compensating period which is during the compensating time in which the non-selective voltage is applied to all scanning electrodes. The effect of the compensating voltage being applied during the compensating time is that the effective voltage applied to each display element becomes uniform. Therefore, it effectively reduces the unevenness of display and thereby provides a high definition display device.

Accordingly, it is an object of this invention to provide an improved method and apparatus for driving a liquid crystal display device wherein a compensating voltage is applied to each signal electrode during a compensating time when the non-selective voltage is applied to the scanning electrodes.

A further object of this invention is to provide an improved method for driving a liquid crystal display device which can be used in conjunction with other methods for improving the unevenness of display of the liquid crystal device.

A still further object of this invention is to provide an improved method and apparatus for driving a liquid crystal display device which reduces the attenuation of the voltage waveforms caused by the low-pass filter effect of the resistance of the signal electrodes and capacitance of the display elements.

Still other objects and advantages of the invention will in part be obvious and will in part be apparent from the specification.

The invention accordingly comprises the several steps and the relation of one or more of such steps with respect to each or the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

As described above, one cause of unevenness of the display in a liquid crystal display panel is the attenuation of the voltage waveforms which result from the R effect of the signal electrodes and display elements when the voltage level on the signal electrode changes. In order to cure this problem a compensating voltage is applied to each signal electrode for a compensating period during the compensating time in which the non-selective voltage is applied to every scanning electrode. This time period during which no selective voltage is applied to any scanning electrodes will hereinafter be referred to as the compensating time TC for frame F1 and compensating time tc for frame F2.

Figure 1:
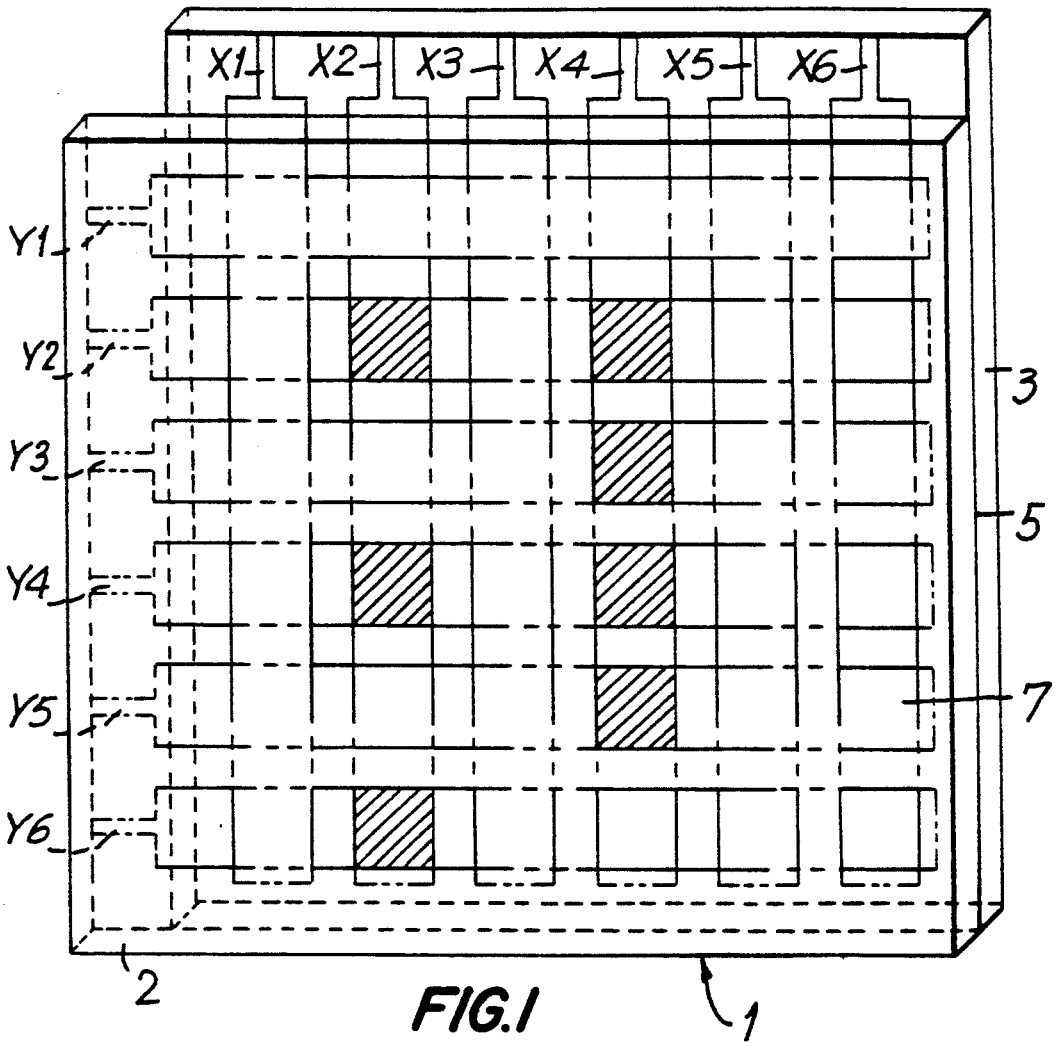
FIG. 1 is a perspective view of the liquid crystal display in accordance with the invention illustrating a sample display pattern.
Figure 2:
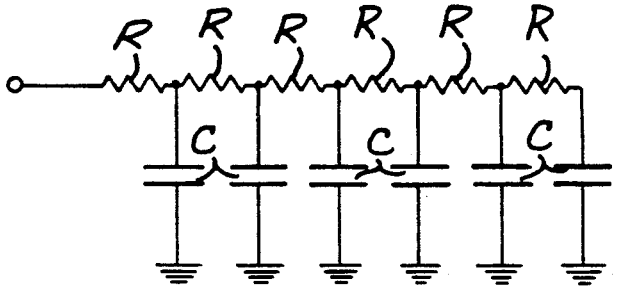
FIG. 2 is a schematic showing an electronic circuit equivalent to the liquid crystal panel of FIG. 1.
Figure 3A:
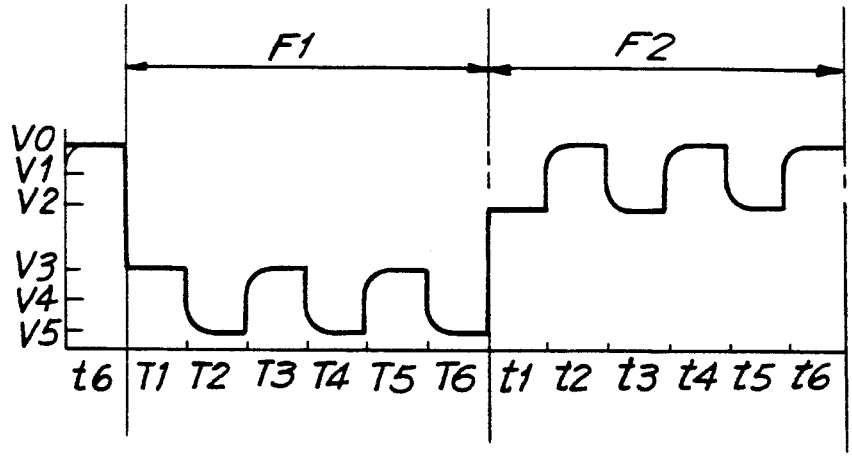
FIGS. 3(*a*)–3(*c*) are voltage waveforms of signal electrode X2, scanning electrode Y4 and the difference (X2–Y4) applied to the display in FIG. 1 before correction.
Figure 3B:
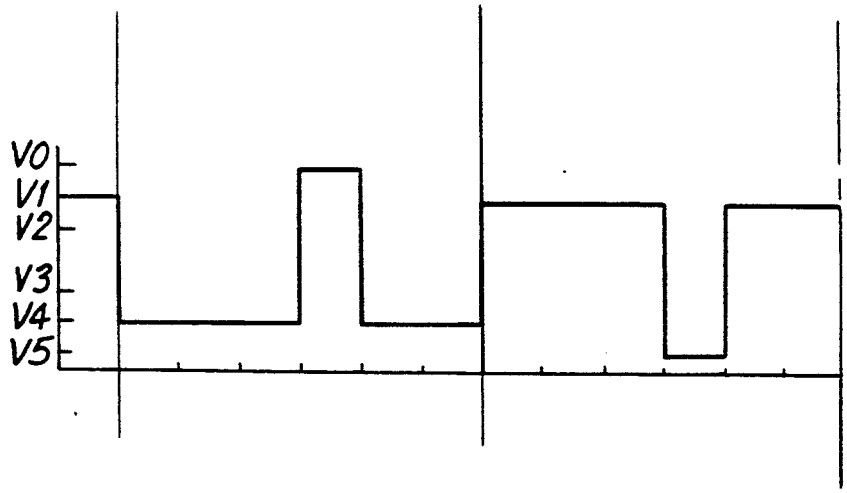
Figure 3C:
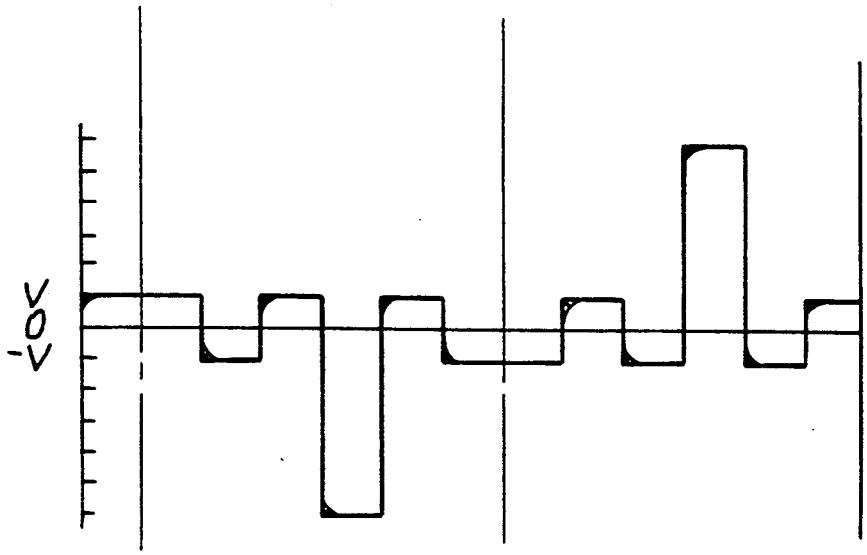
Figure 4A:
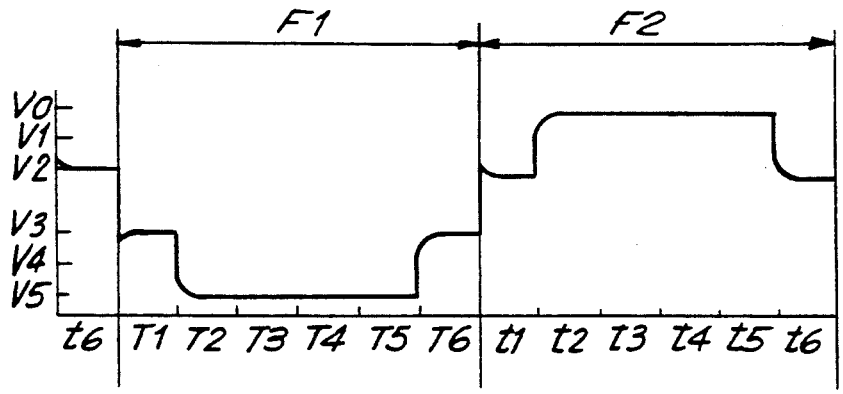
FIGS. 4(*a*)–4(*c*) are voltage waveforms of signal electrode X4, scanning electrode Y4 and the difference (X4–Y4) applied to the display of FIG. 1 before correction.
Figure 4B:
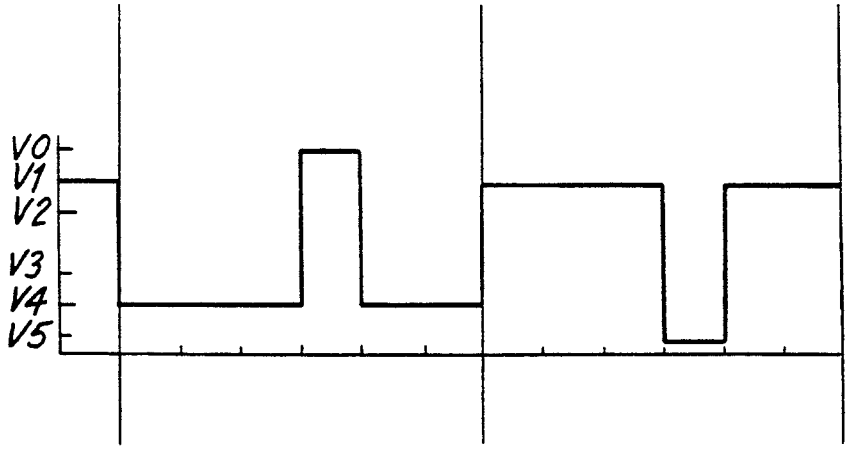
Figure 4C:
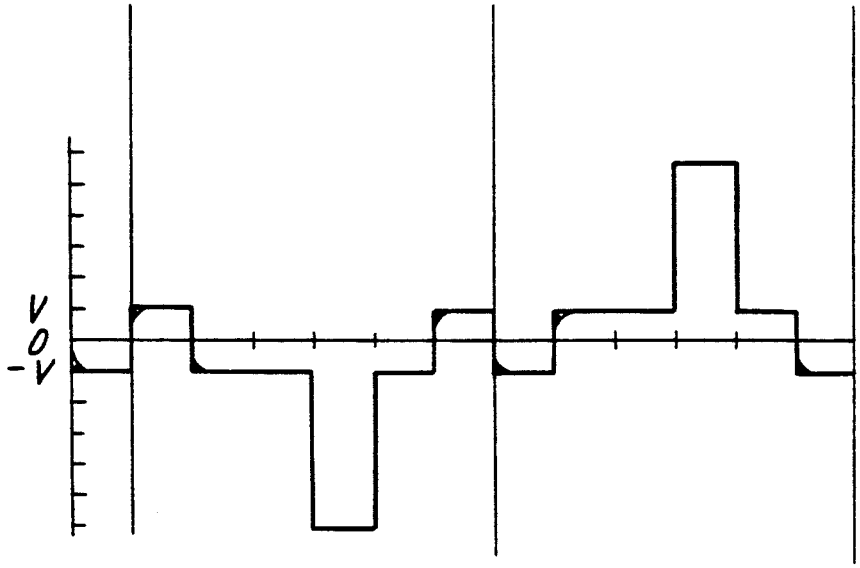
Figures 5A, 5B, 5C:
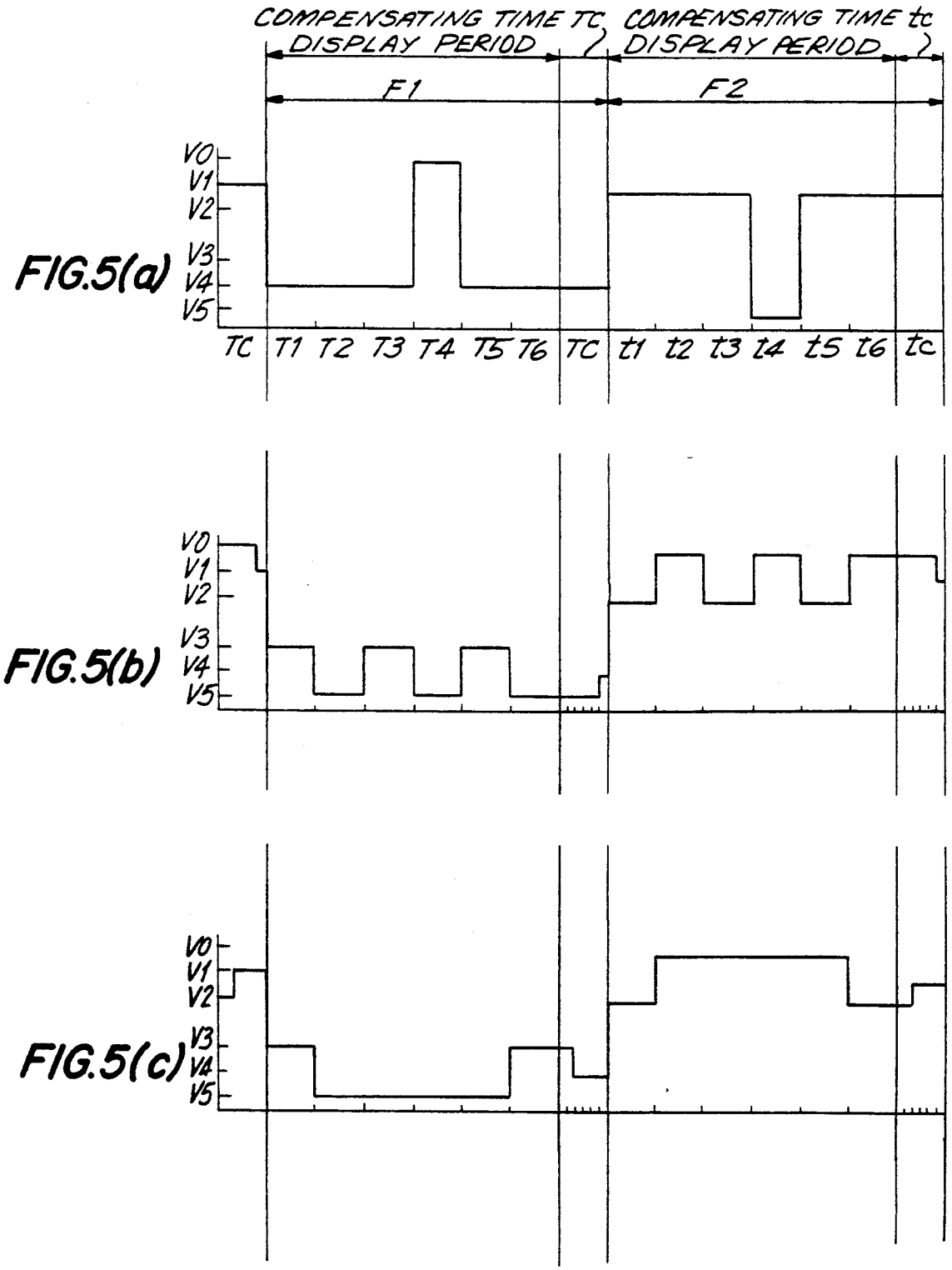
FIGS. 5(*a*)–5(*c*) are voltage waveforms of the scanning electrode Y4, signal electrode X2 and signal electrode X4 applied to the display of FIG. 1 in accordance with the first embodiment of the present invention.

Embodiment 1:

The first embodiment of the present invention will be described with reference to FIGS. 1 and 5(*a*)–5(*c*). FIGS. 5(*a*)–(*c*) illustrate the voltage waveforms applied to individual electrodes of the liquid crystal panel 1 depicted in FIG. 1. FIGS. 5(*a*)–(*c*) also show a driving method of the first embodiment of the present invention. FIG. 1 is a perspective view of the liquid crystal display 1 illustrating the display content and configuration of liquid crystal panel 1. As noted above, liquid crystal panel 1 is constructed of a pair of substrates 2 and 3 with a liquid crystal layer 5 interposed therebetween. Scanning electrodes Y1–Y6 are formed on substrate 2 in substantially the horizontal direction. Signal electrodes X1–X6 are formed on substrate 3 in substantially the vertical direction. At each intersection of a signal electrode X1–X6 and a scanning electrode Y1–Y6 a display element 7 is formed. Display elements 7 depicted with crosshatching represent the lighting condition, and display elements 7 without crosshatching depict the non-lighting condition. When a display element 7 is applied with an effective voltage above the threshold voltage that display element becomes darkened. This darkened condition is referred to as positive display. A 6×6 matrix is used for simplification and explanation, however, in exemplary embodiments much larger matrices would be used.

With particular reference to FIG. 5, in the waveform diagrams disclosed the ordinate axis indicates the voltage applied during the time indicated on the abscissa axis. Voltages V0, V5, V4 and V3 are the selective, lighting, non-selective and non-lighting voltages of the first group, respectively, applied during a first frame F1. Voltages V5, V0, V1 and V2 are the selective, lighting non-selective and non-lighting voltages of the second group, respectively, applied during a second frame F2 of FIG. 5. The first and second voltage groups are periodically interchanged over time. This period in which the voltage groups are interchanged may be arbitrarily set. In the figures of this embodiment, the period is set to a time comprised of the sum of one complete scan of all scanning electrodes plus a compensating time. In all the figures accompanying this specification the periods are represented by frame F1 and frame F2. The symbols T1–T6 of FIG. 5 represent times for which the selective voltage of the first voltage group are applied to scanning electrodes Y1–Y6 of FIG. 1. The symbols t1–t6 of FIG. 5 indicate times for which the selective voltage of the second voltage group are applied to scanning electrodes Y1–Y6 of FIG. 1. The relationship between the voltages is expressed as follows: V0–V1=V1–V2=V3–V4=V4–V5. A ratio obtained by (V0–V5)/V is in the range of 1–50.

FIGS. 5(*a*)–5(*c*) represent the voltage waveforms applied to liquid crystal panel 1 depicted in FIG. 1. FIG. 5(*a*) depicts the voltage waveform applied to scanning electrode Y4 of FIG. 1. Typically, when considering the voltages applied to voltage waveforms of scanning electrodes Y1–Y6, the selective voltage is applied to scanning electrode Y1 for the time T1 (t1), while the non-selective voltage is applied to all other scanning electrodes Y2–Y6. (The scanning electrode to which the selective voltage is applied is referred to as the selective electrode. The scanning electrode to which the non-selective voltage is applied is referred to as the non-selective electrode.) The selective voltage is sequentially shifted to T2 (t2)–T6 (t6), during these time periods the selective voltage is sequentially shifted from Y2-Y3, from Y3-Y4, . . . , from Y5-Y6. At all time periods when a scanning electrode is not selected it is applied with the non-selective voltage. At the next time period immediately following T6 (t6) all the scanning electrodes Y1-Y6 are not selective for a period or time referred to as the compensating time TC (tc). Immediately following the compensating time TC (tc), scanning electrode Y1 becomes selective at the time t1 (T1). Thereafter, each electrode is sequentially applied with the selective voltage as described above. The times T1 (t1)-T6 (t6) are referred to as the display times and the time TC (tc) is referred to as the compensating time.

FIGS. 5(*b*) and 5(*c*) show the voltage waveforms applied to signal electrodes X2 and X4 of FIG. 1, respectively. The signal voltage waveforms represent the lighting and non-lighting voltages applied during each time period. Thus, the display elements formed by the intersection of signal electrodes X1-X6 and scanning electrodes Y1-Y6 being applied with the lighting and selective voltages respectively result in positive display. During the compensating time TC (tc) each scanning electrode Y1-Y6 receives a compensating waveform consisting of the non-selective voltage, except that during a compensating period within the compensating time TC (tc), the lighting or non-lighting voltages are applied to each scanning electrode X1-X6. The compensating period corresponds to the number of variations in polarity of the voltages applied to each signal electrode X1-X6 with respect to the non-selective voltages for that period. The voltage (lighting or non-lighting voltage in this embodiment) applied to the signal electrode during the compensating time TC (tc) is hereinafter referred to as a compensating voltage and is different than the selective voltage applied to the scanning electrodes Y1-Y6 during the compensating time TC (tc). The time for which the different voltage is applied to signal electrodes X1-X6 is referred to as the compensating period. The compensating quantity is obtained by multiplying the compensating voltage by the compensating period. A constant period (frame) as herein defined may be an integral multiple of a sum of the display times and the compensating time TC (tc). In this embodiment, the constant period is frame F1 or F2.

With specific reference to signal electrode X2, there are a large number of variations in polarity of the voltage applied to signal electrode X2 with respect to the non-selective voltage. Signal electrode X2 has its voltage change from the lighting voltage to the non-lighting voltage and from the non-lighting voltage to the lighting voltage five (5) times within one frame. The number five (5) is calculated without counting any changes in voltage during the period of the compensating time TC (tc) or in the period of time immediately following the compensating time TC (tc). Therefore, the lighting or non-lighting voltage, known as the compensating voltage is applied to signal electrode X2 for a long period of time. With reference to signal electrode X4 there are very few variations in the polarity of the voltages applied to signal electrode X4 with respect to the non-selective voltage. In fact, the polarity of the voltages applied to signal electrode X4 only change twice during one frame F1 (F2). Therefore, the compensating voltage (lighting or non-lighting voltage) applied to signal electrode X4 during the compensating time TC (tc) is applied for a short period of time (a short compensating period).

In the first embodiment of this invention the compensating period is proportional to the number of inversions in polarity of the signal voltage wave applied to each signal electrode X1-X6. Thus, in the above example, the compensating period is five sixths of the compensating time in the case of signal electrode X2, and two sixths (one-third) of its compensating time in the case of signal electrode X4. The compensating period is not limited to this relation, but may be obtained by experimentation.

Figures 6A, 6B, 6C:
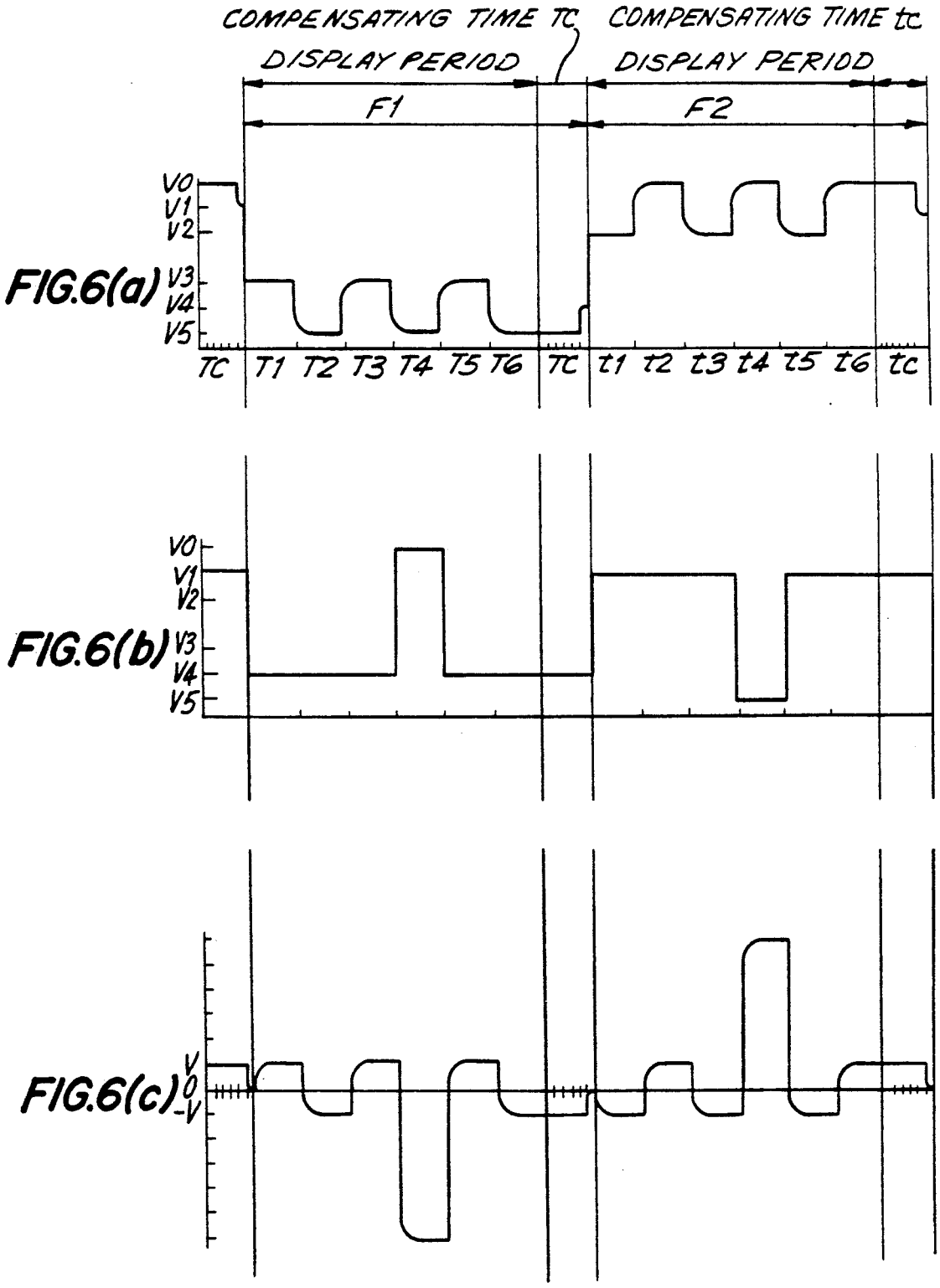
FIGS. 6(*a*)–6(*c*) are voltage waveforms of signal electrode X2, scanning electrode Y4 and the difference (X2–Y4) of the first embodiment of the present invention.

Liquid crystal panel 1 is driven by the voltage waveforms described above. With particular reference to FIGS. 6(*a*)-(*c*) and 7(*a*)-7(*c*) the voltage waveforms applied to each signal electrode and scanning electrode are used to illustrate the actual voltage applied to each display element of liquid crystal panel 1 of FIG. 1.

FIG. 6(*a*) depicts the voltage waveform applied to signal electrode X2 of FIG. 1.

FIG. 6(*b*) depicts the voltage waveform applied to scanning electrode Y4 of FIG. 1. For simplicity the voltage waveform of scanning electrode Y4 has been drawn without any attenuation that may be caused due to the electric resistance of scanning electrode Y1-Y6.

FIG. 6(*c*) depicts the difference between the voltage waveforms of FIGS. 6(*a*) and 6(*b*). Thus, the voltage waveform of FIG. 6(*c*) represents the voltage applied to the display element formed by the intersection of signal electrode X2 and scanning electrode Y4 on liquid crystal panel 1 of FIG. 1.

Figure 7A:
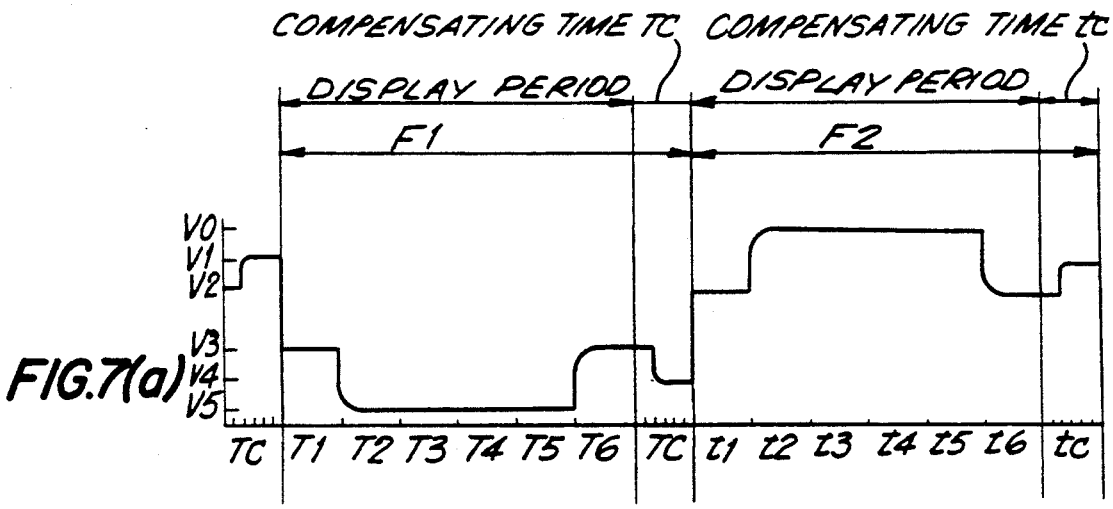
FIGS. 7(*a*)–7(*c*) voltage waveforms of signal electrode X4, scanning electrode Y4 and the difference (X4–Y4) of the first embodiment of the present invention.
Figure 7B:
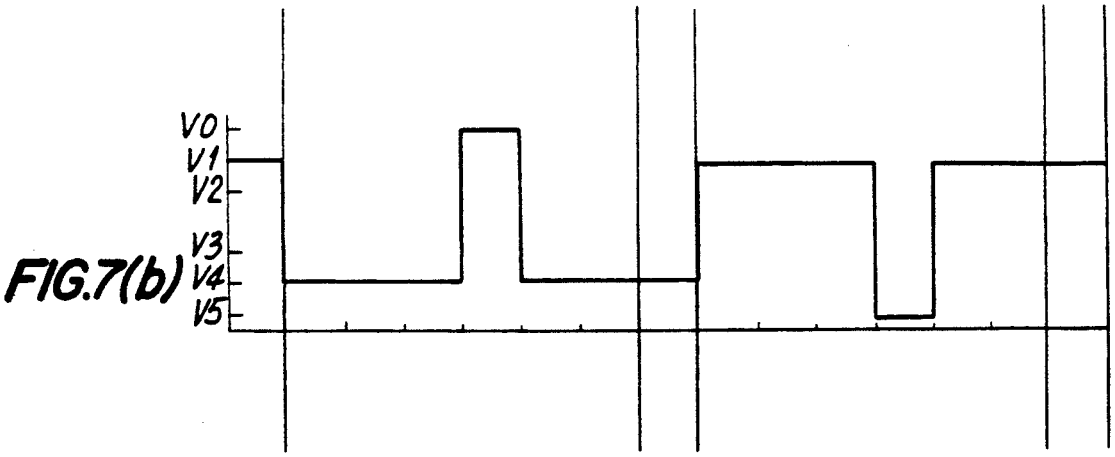
Figure 7C:
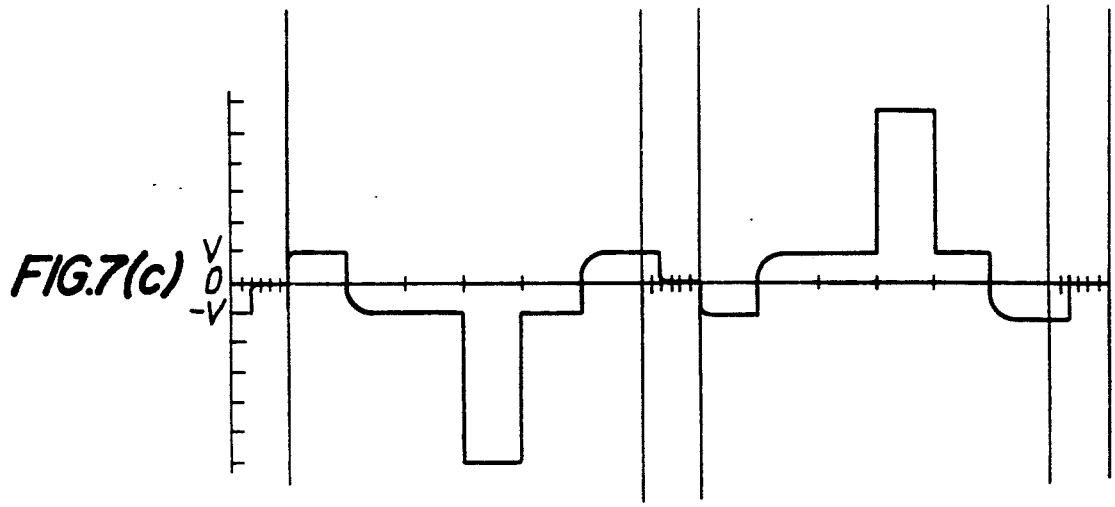

Similarly, FIG. 7(*a*) depicts the voltage waveform of signal electrode X4 of FIG. 1. FIG. 7(*b*) depicts the voltage waveform of scanning electrode Y4 of FIG. 1. To simplify the explanation scanning electrode voltage Y4 has been drawn assuming there is no attenuation of the voltage waveform due to the electric resistance of the scanning electrodes Y1-Y6. FIG. 7(*c*) depicts the difference between the voltage waveforms of FIGS. 7(*a*) and 7(*b*). Therefore, FIG. 7(*c*) depicts the actual voltage applied to the display element formed by the intersection of signal electrode X4 with scanning electrode Y4 of liquid crystal panel 1 of FIG. 1.

Referring to 6(*a*) and 6(*b*) it can be seen that the voltage waveform applied to signal electrode X2 frequently changes from the lighting voltage to the non-lighting voltage and vice versa during each display period, resulting in increased attenuation of the voltage waveform. During the compensating time TC (tc), the quantity and duration of application of compensating voltage applied to signal electrodes corresponds to the attenuation that occurred during the previous display period. Therefore, it is possible to substantially compensate for a reduction in the effective voltage applied to a display element that is caused by the voltages being attenuated during the display period.

On the contrary, in FIGS. 7(*a*) and 7(*b*), the voltage waveform applied to signal electrode X4 infrequently changes from the lighting voltage to the non-lighting voltage and vice versa during the display period. Therefore, much less attenuation takes place on signal electrode X4. Therefore, during compensating time TC (tc), he compensating voltage is applied for a short compensating period. Thus, the reduction in the effective voltage applied to the display element caused by the voltage attenuation during the display time is substantially compensated for and reduced.

As hereinabove discussed, the unevenness of display is effectively eliminated by increasing o decreasing the compensation quantity applied during the compensating time TC (tc) in accordance with the number of variations in polarity of the voltage waveform of signal electrodes X1–X6 with respect to the non-selective voltage applied to the scanning electrodes Y1–Y6 for the display period.

In the above embodiment of the invention a few designations were made for convenience and simplicity, but are not needed in order to practice the invention. For example, the compensating voltages applied to signal electrodes X1–X6 for the compensating time TC (tc) are the lighting or non-lighting voltages. In effect, the difference between the lighting and non-lighting voltages and the non-selecting voltage effects compensation. The lighting or non-lighting voltages were used in order to limit the number of different voltages supplied to the liquid crystal panel 1. However, if necessary any appropriate voltage may be used as the compensating voltage. Furthermore, the voltage waveform applied as the compensating voltage is shown as a rectangular waveform, but, the voltage waveform may assume any other arbitrary shape. Furthermore, the compensating time TC (tc) may also be increased or decreased as necessity requires.

Figure 8:
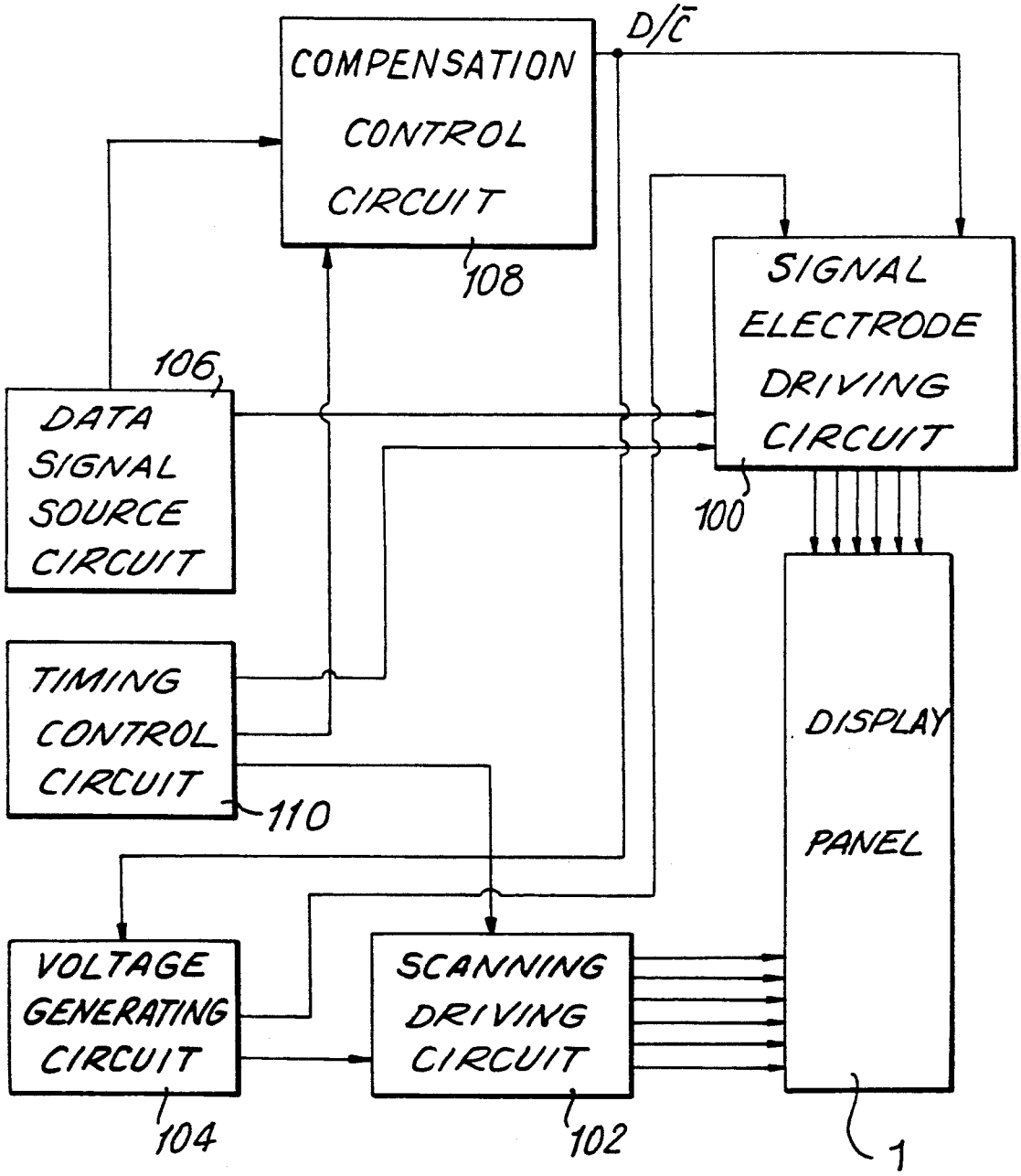
FIG. 8 is a block diagram of an apparatus for driving a liquid crystal display panel in accordance with the first embodiment of the present invention.

An apparatus for practicing the first embodiment of the method of the invention is depicted in the block diagram of FIG. 8. In FIG. 8, a 6×6 liquid crystal display panel 1 having a structure similar to that depicted in FIG. 1 is depicted. The lighting and non-lighting voltages are applied to signal electrodes X1–X6 of display panel 1 by signal electrode driving circuit 100. The selective voltage is sequentially applied to scanning electrodes Y1–Y6 of display panel 1 by scanning driving circuit 102. The lighting voltage, non-lighting voltage, selective voltage and non-selective voltage are produced by voltage generating circuit 104 and applied to the scanning driving circuit 102 and signal electrode driving circuit 100. The input data signal, representative of the pattern to be displayed on display panel 1, is applied by data signal source circuit 106 to a compensation control circuit 108 and signal electrode driving circuit 100. Frame, latch, clock and other timing signals required for the operation of the circuit of FIG. 8 are produced by timing control circuit 110 and applied to signal electrode driving circuit 100, scanning driving circuit 102 and compensation control circuit 108. Compensation control circuit 108 produces compensation control display/compensate switching signal $D/\overline{C}$ to perform the compensation function during a predetermined compensating time during which the selective voltage is not applied to any one of the plurality of scanning electrodes.

Figure 9:
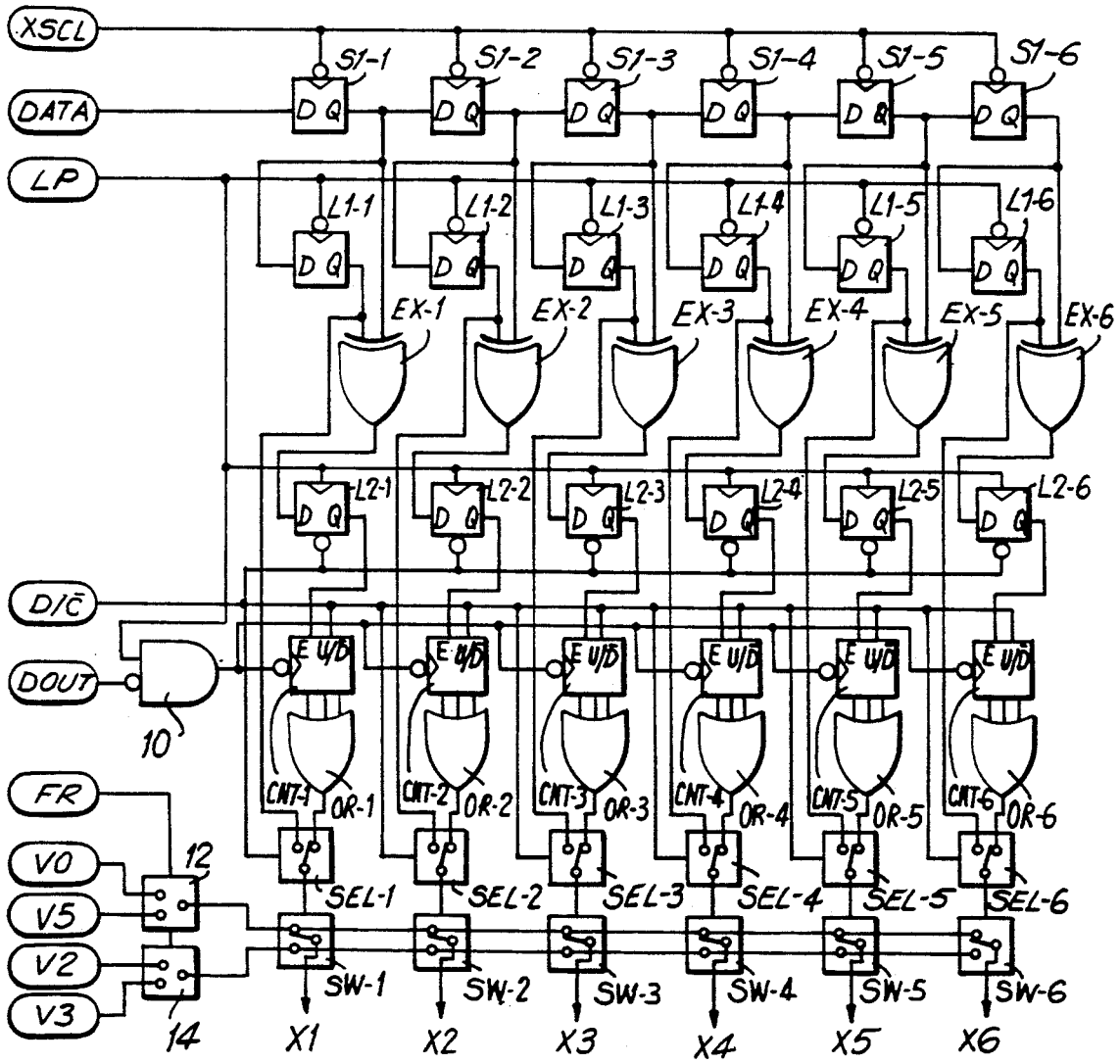
FIG. 9 is a schematic diagram of an embodiment of the signal electrode driving circuit (X-driver circuit) of FIG. 8.

Particular reference is now made to FIG. 9, wherein one embodiment of signal electrode driving circuit (X-driving circuit) 100 of FIG. 8 is depicted. Shift registers S1-1 to S1-6 receive the signal input at the D terminal input thereof at the trailing edge or clock signal XSCL. The input data applied to shift register S1 is shifted from shift register S1-1 to S1-2, S1-2 to S1-3, S1-3 to S1-4, S1-4 to S1-5, and S1-5 to S1-6 by the trailing edge of clock signal XSCL. The first group of latch circuits L1-1 to L1-6 each receive the data output from the Q terminal of the corresponding one of shift registers S1-1 to S1-6 at the trailing edge of latch signal LP (after the data for all of the display elements 7 along one of scanning electrodes Y1–Y6 is loaded in shift registers S1-1 through S1-6). Exclusive OR circuits EX-1 to EX-6 each compares the output from the shift registers S1-1 to S1-6 and the output from the Q terminal of the corresponding one of latch circuits L1-1 to L1-6. Exclusive OR circuit Exn outputs a "1" when the output data of shift register S1-n does not correspond to the output data of latch circuit L1-n (for n equals 1 through 6). Alternatively, when shift register S1-n and latch circuit L1-n output the same signal to exclusive OR circuit EX-n, a "0" is output by the exclusive OR circuit. The second group of latch circuits L2-1 to L2-6 have a preset function and receive the output data from exclusive OR circuits EX-1 to EX-6 at the leading edge of latch signal LP (before the data for the next scanning electrode is input into first latch circuit L1-1 through L1-6). The display/compensate switching signal (hereinafter referred to as signal $D/\overline{C}$) is input into the preset terminals of second latch circuits L2-1 through L2-6 so that the second latch circuits all unconditionally output "1" when the signal $D/\overline{C}$ is "0".

Counter circuits CNT-1 to CNT-6 have an enable function (E) and an up/down selecting function ($U/\overline{D}$). Latch circuits L2-1 to L2-6 are connected to the enable E and signal $D/\overline{C}$ is input into the up/down selecting function $U/\overline{D}$ of the counter circuits. When a "1" is input into both the enable E and the up/down selecting function $U/\overline{D}$, the counter circuit acts as an incremental counter and adds +1 at the leading edge of signal LP. Further, when "1" is input into enable E and "0" is input into up/down select function $U/\overline{D}$, the counter circuit acts as a decremental counter and adds −1 at the trailing edge of latch signal LP until the counter circuit counts to 0. Furthermore, when "0" is input into E, there is no change in the counter. Thus, when signal $D/\overline{C}$ is "1", up/down counters CNT-1 to CNT-6 incrementally count up each time the display on the corresponding signal electrodes X1–X6 changes from lighting to non-lighting or non-lighting to lighting as the scanning electrodes Y1–Y6 are sequentially scanned.

AND circuit 10 receives two inputs, the first input is a negative logic input terminal and is connected to signal DOUT, and the second is a positive logic input terminal and is connected to signal LP. Thus, AND circuit 10 masks the clock signal LP of the counter circuit when the signal DOUT is "0". OR circuits OR-1 to OR-6 receive the output data from counter circuits CNT-1 to CNT-6 and output to data selector circuits SEL-1 to SEL-6, respectively. Data selector circuits SEL-1 to SEL-6 select the output from the Q terminal of the corresponding one of first latch circuits L1-1 through L1-6 when the signal $D/\overline{C}$ is "1", and select the output from the corresponding one of OR circuits OR-1 to OR-6 when signal $D/\overline{C}$ is "0".

Analog switches 12 and 14 output the lighting voltage V0 and non-lighting voltage V2 respectively when frame signal FR is "1", and they output the lighting voltage V5 and non-lighting voltage V3 respectively when frame signal FR is "0". Analog switches SW-1 to SW-6 respectively output the lighting voltage (V0 or V5) when the corresponding data select circuits SEL-1 through SEL-6 output "1". Alternatively, analog switch SW-n outputs the non-lighting voltages (V2 or V3) when data selector circuit SEL-n outputs "0".

Figure 10:
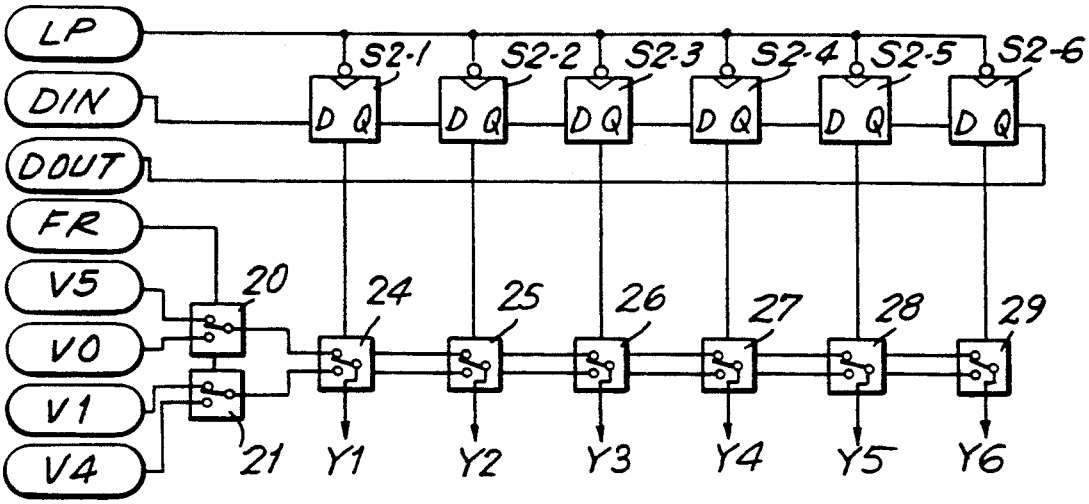
FIG. 10 is a schematic diagram of a scanning driving circuit (Y-driver circuit) of FIG. 8.

Reference is next made to FIG. 10, wherein the structure of an embodiment of scanning driving circuit (Y-driver circuit) 102 is depicted. The scanning driving circuit of this invention operates in the same manner as a Y-driver circuit of a conventional liquid crystal matrix display. The first of the shift registers S2-1 to S2-6 receives signal DIN as a "1" at the trailing edge of latch signal LP in order to shift the "1" value of signal DIN sequentially from shift register to shift register by successive trailing edges of latch signal LP. Signal DOUT is produced when the "1" value of signal DIN is stored in shift register S2-6, meaning that the last scanning electrode is being scanned. Analog switch 20 outputs either the lighting voltage V5 or V0 depending upon the start of frame signal FR and analog switch 21 outputs either non-lighting voltage V1 or V4 in accordance with frame signal FR. Furthermore, analog switches 24 through 29 output the output from analog switches 20 or 21 in accordance with the output data received from the corresponding shift registers S2-1 to S2-6.

Figure 11:
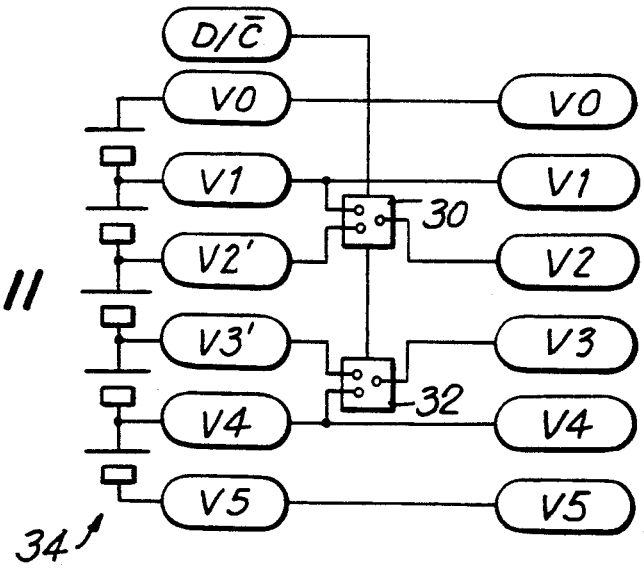
FIG. 11 is a schematic diagram of a voltage generating circuit of FIG. 8.

Reference is next made to FIG. 11 wherein an embodiment of voltage generating circuit 104 is depicted, which is comprised of a power circuit 34 for generating voltages V0 to V5 and switch circuits 30 and 32 for switching the voltages output according to signal $D/\overline{C}$. The following relationship exists between the voltages:

$V=V0-V1=V1-V2'=V3'-V4=V4-V5$ $V2'-V3=kV$ $K=1$ to 30

Output voltages V2 and V3 are controlled by analog switches 30 and 32 respectively. V2 is equal to V2' when signal $D/\overline{C}$ is "1". Alternatively, V2 equals V1 when signal $D/\overline{C}$ equals "0". Similarly, V3 is equal to V3' when signal $D/\overline{C}$ equals "1", and V3 is equal to V4 when signal $D/\overline{C}$ equals "0".

Figure 12:
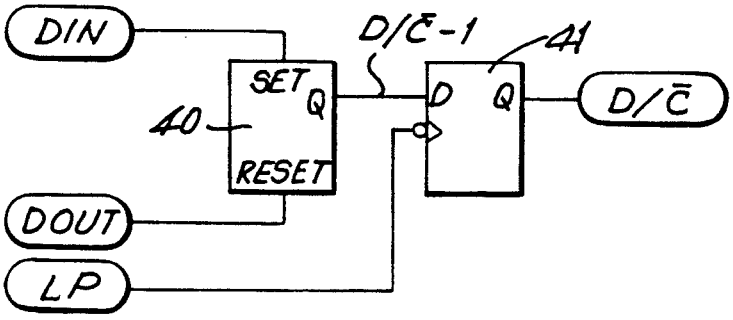
FIG. 12 is a block diagram of the compensation control circuit of FIG. 8 for the forming signal D/C.

Referring specifically to FIG. 12, compensation control circuit 108 that generates signal $D/\overline{C}$ is depicted. Flip-flop circuit 40 is set to "1" by signal DIN and is reset to "0" by signal DOUT. The output of flip-flop 40 (signal $D/\overline{C}$-1) is input into D flip-flop 41 at the trailing edge of signal LP, and outputs signal $D/\overline{C}$. The operation of this circuit is clearly shown from the timing chart indicated as FIG. 12.

Figure 13A:
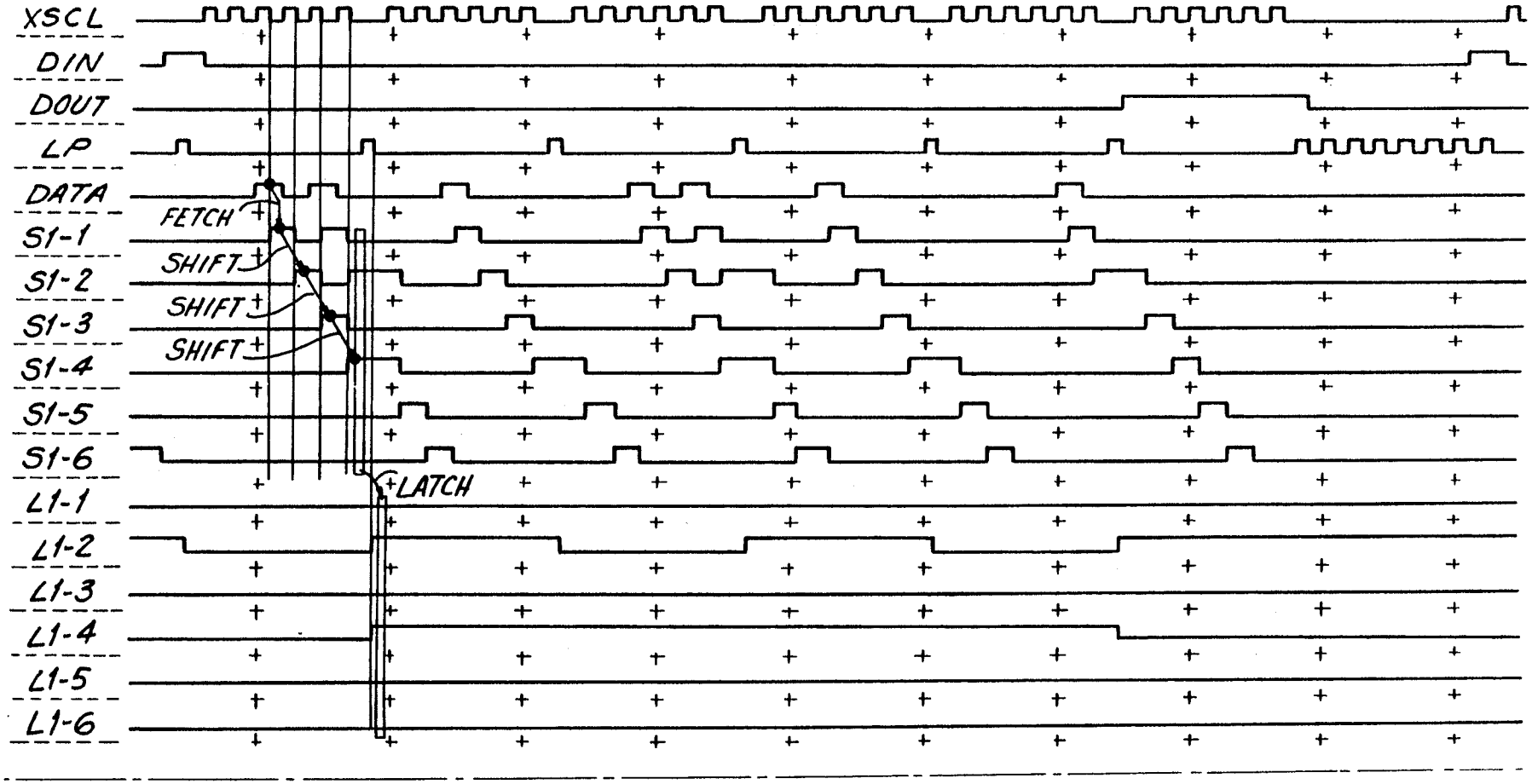
FIGS. 13(*a*), 13(*b*) and 13(*c*) are a timing diagram of the circuit of FIG. 9.
Figure 13B:
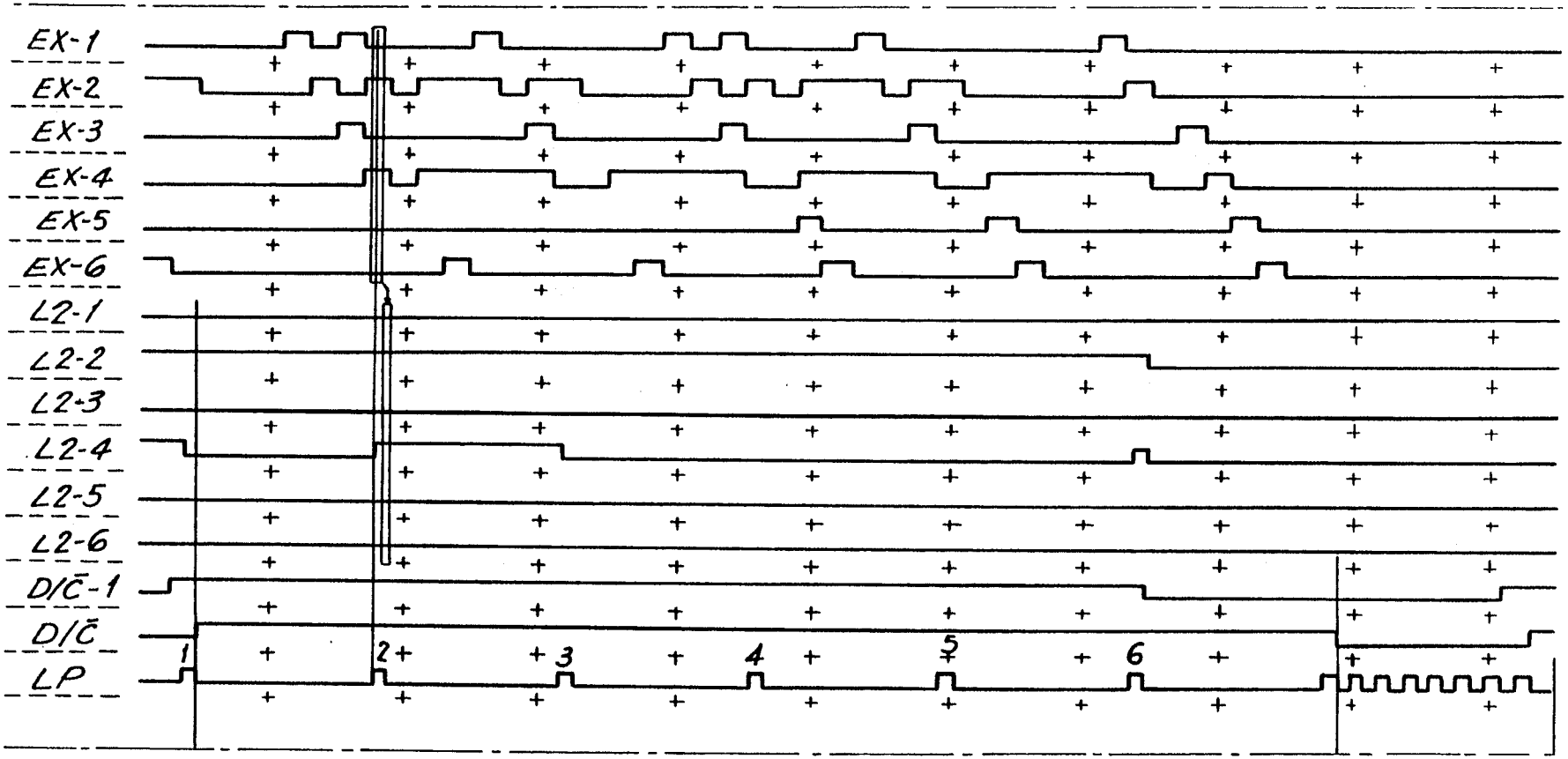
Figure 13C:
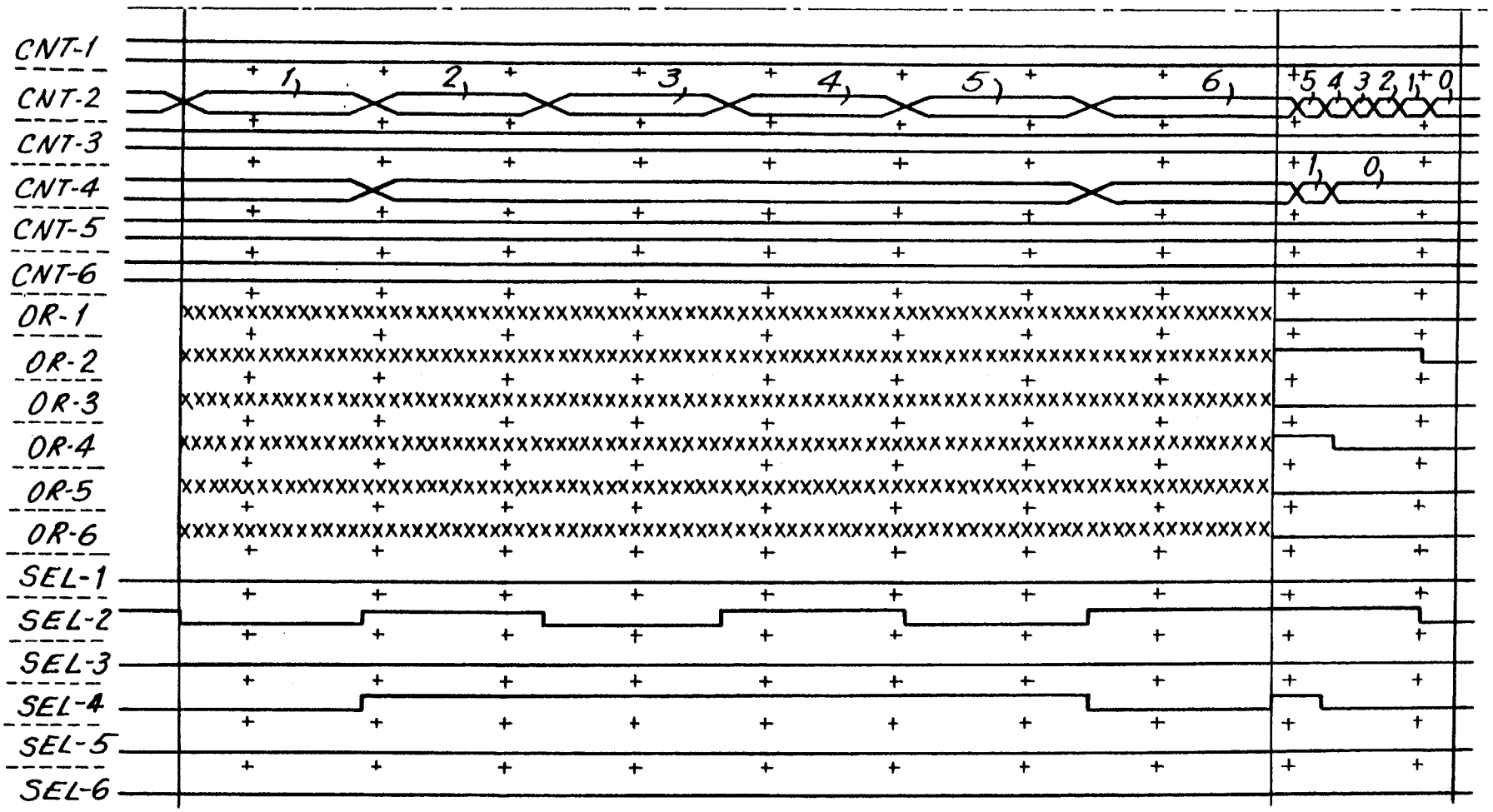

Reference is next made to FIGS. 13(*a*), 13(*b*) and 13(*c*), wherein a timing diagram of the X driver circuit of FIG. 8 is depicted. During the display period signal $D/\overline{C}$ is "1", and shift registers S-1 to S-6 receive the data concerning the next selected display element on the scanning electrode at the trailing edge of signal XSCL. The exclusive OR circuits EX-1 to EX-6 analyze whether the data of shift registers S1-1 to S1-6 and latch circuits L1-1 to L1-6 correspond to each other, and exclusive OR circuits EX-1 to EX-6 transmit the resulting data to latch circuits L2-1 to L2-6 at the leading edge of signal LP.

The first group of latch circuits L1-1 to L1-6 receive data from the shift registers S1-1 to S1-6 at the trailing edge of signal LP. Simultaneously, counter circuits CNT-1 to CNT-6 count up (+1) when the latch circuits of the second group L2-1 to L2-6 output "1". The foregoing operation is repeated during the entire display period when signal $D/\overline{C}$ is "1". The result being that each counter circuit CNT-1 to CNT-6 counts the frequency with which the lighting and non-lighting voltages switch for each signal electrode.

The X driver circuit of the present invention outputs the same voltage waveform as a conventional X-driver circuit during the time in which signal $D/\overline{C}$ is "1". At the trailing edge of signal LP, the latch circuits of the first group receive the data which was received by the shift registers S1-1 to S1-6 at the trailing edge of signal XSCL. Switches SW-1 to SW-6 output the lighting voltage or non-lighting voltage in accordance with the output data from the latch circuits L1-1 to L1-6.

Upon the completion of a scan of all of scanning electrodes Y1 to Y6, signal $D/\overline{C}$ becomes "0" during the compensating time TC (tc). During this compensating time, a selective voltage is not applied to any scanning electrode Y1–Y6 and counter circuits CNT-1 to CNT-6 act as decrement counters to add −1 at the trailing edge of signal LP. Exclusive OR circuits OR-1 to OR-6 correspond to the counter circuits and repeatedly output "1" until counter circuits CNT-1 to CNT-6 count down to 0. Accordingly, the larger the value counted by a counter circuit, the longer the period the corresponding OR circuits will output "1". Furthermore, the voltage output to signal electrodes X1–X6 while signal $D/\overline{C}$ is "0" is determined based on the output data from the exclusive OR circuits OR1–OR6. Specifically, the lighting voltages (V0 or V5) are output when the output data from exclusive OR circuits OR1 to OR6 is "1", and the non-lighting voltages (V1 or V4) are output when the output data from exclusive OR circuits OR1 to OR6 is "0".

The X driver circuit of the present invention acts as a conventional X driver circuit during the display period. Alternatively, during the compensating time, TC (tc) when no scanning electrode is applied with a selective voltage, a lighting voltage will be applied for a long period of time to those signal electrodes that have changed from the lighting to non-lighting or non-lighting to lighting voltage many times during the display period. Alternately, the lighting voltage will be applied for a short period of time during the compensating time to those signal electrodes that have not changed many times during the display period.

The compensating period within the compensating time is appropriately corrected through the use of AND circuit 10. This can be explained through the use of the timing charts. Looking at counter circuit CNT-4, without AND circuit 10 a 2 would be output just prior to the compensating period. In this case, with an AND circuit, the latch signal LP applied just prior to the compensating time makes CNT-4 output 1 instead of 2 because the latch signal LP is marked by the "1" of signal DOUT. This arrangement is adapted because any change from lighting to non-lighting or non-lighting to lighting voltage just prior to the compensating time is not counted as a change that would effect the compensating period. Thus, for counter CNT-4 the compensating period is just 1 clockperiod of latch signal LP.

Embodiment 2

Figures 14A, 14B, 14C:
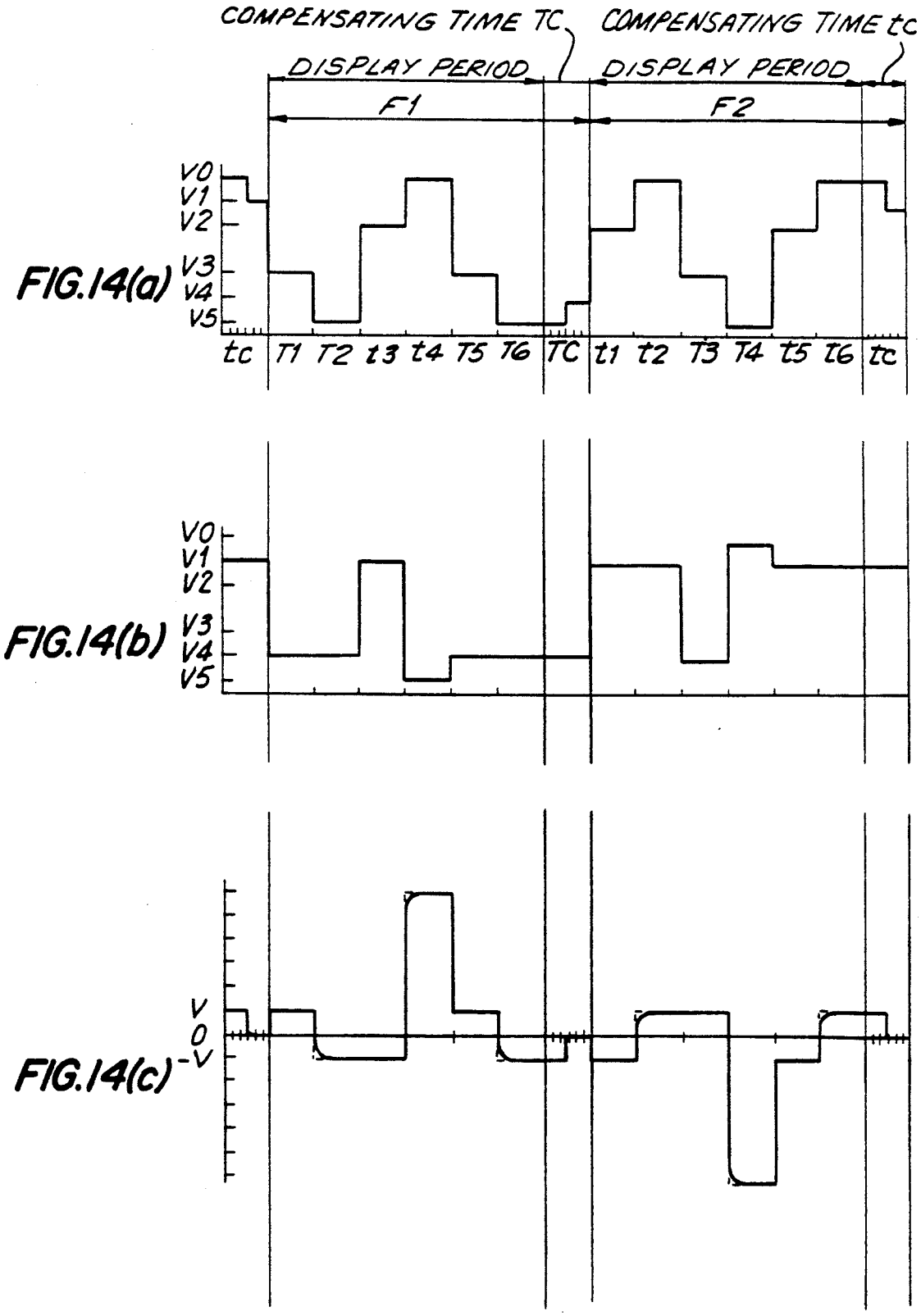
FIGS. 14(*a*)–14(*c*) are voltage waveforms of signal electrode X2, scanning electrode Y4 and the difference (X2–Y4) of the second embodiment of the present invention.

The second embodiment of the present invention utilizes the line inverse driving method described above in conjunction with the present invention. The line inverse driving method as utilized herein inverts the voltages applied to both the signal electrodes and the scanning electrodes after each period in which the selected voltage is applied to two (2) scanning electrodes Y1–Y6. FIGS. 14(*a*)–14(*c*) depict voltage waveforms, wherein the line inverse driving method is applied in conjunction with the present invention to the liquid crystal panel 1 of FIG. 1. FIG. 14(*a*) illustrates the signal voltage waveform applied to signal electrode X2 of FIG. 1. FIG. 14(*b*) depicts the scanning electrode voltage waveform applied to scanning electrode Y4 of FIG. 1. FIG. 14(*c*) depicts the difference between the voltage waveforms of FIGS. 14(*a*) and 14(*b*) with dotted lines indicating where the actual voltage waveform deviates from the ideal waveform. Further, FIG. 14(*c*) also illustrates the voltage waveform applied to the display element formed by the intersection of signal electrode X2 with scanning electrode Y4. As illustrated in FIG. 14(*a*), when shifting from time T2 (t2) to time t3 (T3) and from time T4 (t4) to time t5 (T5), in both cases the voltage waveform of signal electrode X2 is changed from the lighting voltage to the non-lighting voltage. Simultaneously, the voltages of one voltage group are interchanged with the voltages of the other voltage group. Hence, there is no variation in the polarity of the voltage of the signal electrode X2 with respect to the non-selective voltage of the scanning electrodes Y1–Y6. Thus, under the line inverse driving method, the polarity of the voltage waveform of signal electrode X2 changes only three times during the first frame F1. Hence, the compensating period of signal electrode X2 is shorter in the second embodiment than in the first embodiment. FIG. 14(*c*) illustrates that the voltage actually applied to the display element undergoes attenuation three (3) times within frame F1, whereas, in FIG. 6(*c*) the voltage waveform applied to signal electrode X2 undergoes attenuation five (5) times within frame F1. Thus, the compensating quantity applied during compensating time TC (tc) that corresponds to the attenuation of signal electrode X2, is thereby substantially reduced. Thus, the reduction in the effective voltage applied to the display element is effectively reduced by a smaller compensating quantity.

As discussed above, the unevenness of display can be effectively reduced by combining the line inverse driving method of reducing unevenness of display with the present invention.

Figure 15A:
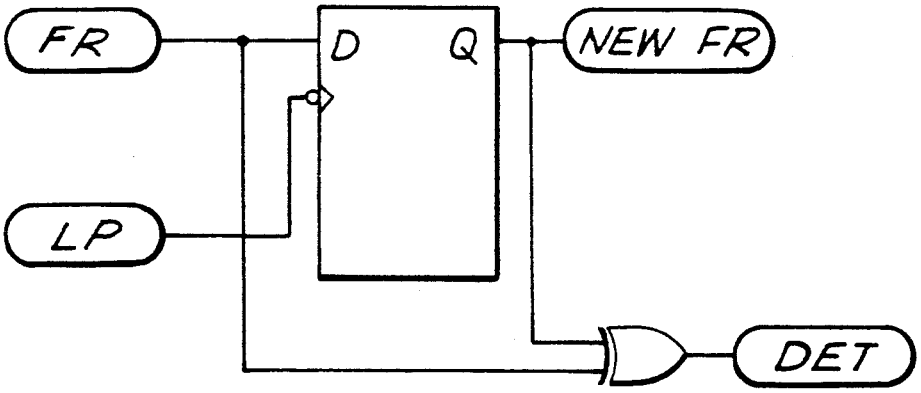
FIG. 15(*a*) and 15(*b*) are block diagrams showing the modifications made for the second embodiment of the invention.
Figure 15B:
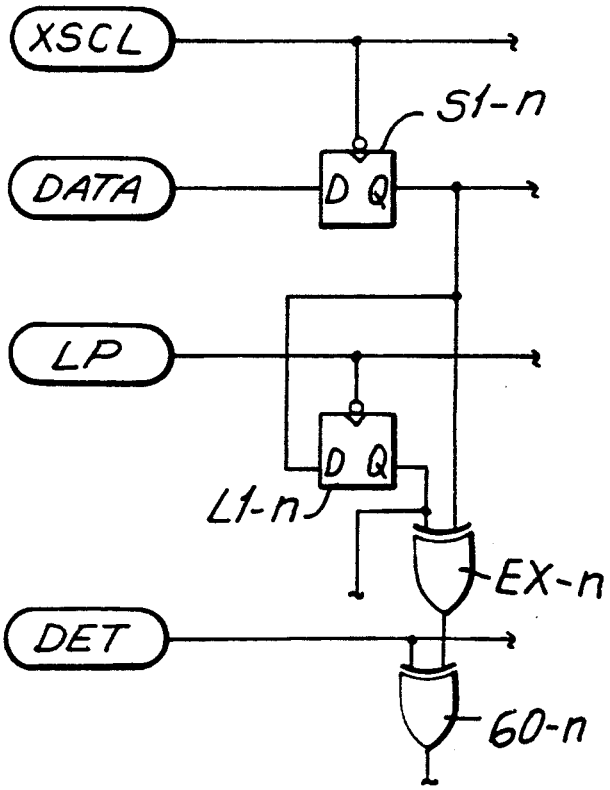

Reference is next made to FIGS. 15(*a*)–15(*b*), wherein changes in the circuitry of the first embodiment to practice the method of the second embodiment are depicted, reflecting the adoption of the line inverse driving method. In this driving method, frame signal FR changes in sync with latch signal LP. The circuit depicted in FIG. 15(*a*) detects the changes of frame signal FR and outputs detection signal DET. The new frame signal FR (in sync with latch signal LP) is used as latch signal FR of the X-driver circuit and Y-driver circuit of FIGS. 9 and 10. FIG. 15(*b*) depicts the change for the nth signal electrode driving circuit 100 to carry out the second embodiment. Exclusive OR circuit 60 of FIG. 15(*b*) receives the output data from exclusive OR circuit EX-n. Furthermore, exclusive OR circuit 60-n of FIG. 15(*b*) also receives detection signal DET of FIG. 15(*a*). The data output by exclusive OR circuit 60-n is received by latch circuit L2-n as the D input thereof. Thereafter the operation of the signal electrode driving circuit is similar to that of the first embodiment.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of driving a liquid crystal panel to produce a display pattern at display elements of a panel having a plurality of scanning electrodes on one of a pair of substrates between which a liquid crystal layer is interposed and a plurality of signal electrodes on the other substrate, a display element being defined at the intersection of a scanning electrode and a signal electrode, comprising the steps of:

providing, during the operation of said panel, periods of time during which said panel is driven to produce a display pattern (the driving times), and periods of time during which said panel is compensated at least in part for display unevenness during a preceding display time due to the display pattern (the compensation times);

applying a scanning driving waveform including at least a selective and a non-selective voltage to at least one end of each scanning electrode during said driving times;

applying a data driving waveform including at least a non-lighting and a lighting voltage to at least one end of each signal electrode during said driving times; and during said compensating times, not applying the selective voltage to any of the plurality of scanning electrodes and applying a compensating waveform as required to one or more of the signal electrodes of the liquid crystal panel for compensating at least in part for display unevenness during a preceding display time due to the display pattern.

2. The method of claim 1, wherein the compensating waveform applied to each signal electrode during a compensating time is varied at least in part in accordance with the number of variations between lighting and non-lighting voltages applied to that signal electrode which result in a change in polarity with respect to the non-selective voltages applied to the scanning electrodes during a predetermined period of a display time preceding the compensating time.

3. The method of claim 2, wherein the compensating waveform includes a compensating voltage, the value of the compensating voltage applied to each signal electrode being varied at least in part in accordance with the number of variations between lighting and non-lighting voltages applied to that signal electrode which result in a change in polarity with respect to the non-selective voltages applied to the scanning electrodes during a predetermined period of a display time preceding a compensating time.

4. The method of claim 3, wherein the compensating voltage applied to each of said signal electrodes is increased at least in part as the number of variations between the lighting and non-lighting voltages applied to that signal electrode which result in a change in polarity with respect to the non-selective voltage applied to the scanning electrodes increases during a predetermined period of the display time preceding a compensating time.

5. The method of claim 3, wherein the compensating voltage is selected from the lighting and non-lighting voltages.

6. The method of claim 2, wherein the compensation waveform includes a compensating voltage applied during a selected portion of the compensation time, the duration of the portion of the compensating time during which the compensating voltage is applied to each signal electrode being varied at least in part in accordance with the number of variations between lighting and non-lighting voltages applied to that signal electrode which result in a change in polarity with respect to the non-selective voltages applied to the scanning electrodes during a predetermined period of a display time preceding a compensating time.

7. The method of claim 6, wherein the duration of the portion of the compensating time during which the compensating voltage is applied is increased at least in part as the number of variations between the lighting and non-lighting voltages applied to that signal electrode which result in a change in polarity with respect to the non-selective voltage applied to the scanning electrodes increases during a predetermined period of a display time preceding a compensating time.

8. The method of claim 1, wherein the polarity of the selective, non-selective, lighting and non-lighting voltages is periodically reversed, a compensating time occurring a selected time after a polarity reversal.

9. The method of claim 8, wherein the compensating waveform applied to each signal electrode is varied in accordance with the number of variations between lighting and non-lighting voltages applied to that signal electrode which result in a change in polarity with respect to the non-selective voltages applied to the scanning electrodes during the period since the prior compensation time.

10. An apparatus for driving a liquid crystal panel to produce display patterns at display elements of a panel having a plurality of scanning electrodes on one of a pair of substrates between which a liquid crystal layer is interposed and a plurality of signal electrodes on the other substrate, a display element being defined at the intersection of a scanning electrode and a signal electrode, comprising:

scanning driving circuit means for applying a scanning driving waveform including at least a selective and a non-selective voltage to at least one end of each scanning electrode;

signal electrode driving circuit means for applying a data driving waveform including at least a non-lighting and a lighting voltage to at least one end of each signal electrode, said signal electrode driving circuit means further including compensation circuit means for producing a compensating waveform selected to compensate at least in part for display unevenness due to the display pattern;

compensation control circuit means for defining, during the operation of said panel, driving times during which said scanning driving waveform is applied to said scanning electrodes by said scanning driving circuit means and said data driving waveform is applied to said signal electrodes by said signal electrode driving circuit means to produce display patterns at said display elements, and for defining, during the operation of said panel, compensation times during which the selective voltage is not applied to any of the plurality of scanning electrodes and said compensating waveform is applied as required to one or more of said signal electrodes, said compensating waveform being selected to compensate at least in part for display unevenness due to the display pattern during a driving time preceding the compensating time.

11. Apparatus of claim 10, wherein said compensation circuit means is adapted to detect the transitions from the lighted to the non-lighted state and from the non-lighted state to the lighted state of adjacent display elements along each signal electrode for a predetermined period of a display time and for applying said compensating waveform to that signal electrode during a compensating time following said predetermined period of display time, said compensating waveform being selected at least in part in accordance with the number of such variations.

12. The apparatus of claim 11, and including masking circuit means for preventing said compensating circuit means from counting a transition from a lighting to a non-lighting state and from a non-lighting state to a lighting state between the last display element and the first display element on a signal electrode.

13. The apparatus of claim 11, wherein said compensating waveform includes a compensating voltage, said compensating circuit means being adapted to select the value of said compensating waveform at least in part in accordance with the number of such variations.

14. The apparatus of claim 11, wherein said compensating waveform includes a compensating voltage applied during a selected portion of the compensating time, said compensation circuit means being adapted to select the duration of the portion of the compensating time during which the compensating voltage is applied to that signal electrode at least in part in accordance with the number of such variations.

15. The apparatus of claim 10, wherein said compensating circuit means is adapted to detect the variations between lighting and non-lighting states and the non-lighting and lighting states of adjacent display elements along a signal electrode which result in a change of polarity with respect to the non-selective voltages applied to the scanning electrodes during a predetermined period of a display time and for selecting a compensating waveform having a voltage value which varies at least in part in accordance with the number of such variations for application to that signal electrode during a compensating time following that predetermined period of a display time.

16. The apparatus of claim 15, and including masking circuit means for preventing said compensating circuit means from counting a transition from a lighting to a non-lighting state and from a non-lighting state to a lighting state between the last display element and the first display element on a signal electrode.

17. The apparatus of claim 15, wherein said compensating voltage is selected from the lighting and non-lighting voltages.

18. The apparatus of claim 15, wherein said compensating waveform includes a compensating voltage applied during a selected portion of the compensating time, said compensation circuit means being adapted to selected the duration of the portion of the compensating during which the compensating voltage is applied to that signal electrode at least in part in accordance with the number of such variations.

19. The apparatus of claim 10, wherein the polarity of the selective, non-selective, lighting and non-lighting voltages is periodically reversed, a compensating time occurring a selected time after a polarity reversal.

* * * * *